US005559521A

United States Patent [19]

Evans et al.

[11] Patent Number: 5,559,521

[45] Date of Patent: Sep. 24, 1996

[54] ANTENNAS WITH MEANS FOR BLOCKING CURRENT IN GROUND PLANES

[75] Inventors: James G. Evans, Colts Neck; Martin V. Schneider; Robert W. Wilson, both of Holmdel, all of N.J.

[73] Assignee: Lucent Technologies Inc., Murray Hill, N.J.

[21] Appl. No.: 351,905

[22] Filed: Dec. 8, 1994

[51] Int. Cl.[6] ..... H01Q 1/38

[52] U.S. Cl. ..... 343/700 MS; 343/846

[58] Field of Search ..... 343/700 MS, 846, 343/848, 795; H01Q 1/38

[56] References Cited

U.S. PATENT DOCUMENTS

| | | | |
|---|---|---|---|
| 4,131,894 | 12/1978 | Schiavone | 343/700 MS |
| 4,170,013 | 10/1979 | Black | 343/700 MS |
| 4,197,544 | 4/1980 | Kaloi | 343/700 MS |
| 4,364,050 | 12/1982 | Lopez | 343/700 MS |
| 4,477,813 | 10/1984 | Weiss | 343/700 MS |
| 4,623,893 | 11/1986 | Sabban | 343/700 MS |
| 4,719,470 | 1/1988 | Munson | 343/700 MS |
| 5,155,493 | 10/1992 | Thursby et al. | 343/700 MS |
| 5,227,749 | 7/1993 | Raguenet et al. | 343/700 MS X |
| 5,307,075 | 4/1994 | Huynh | 343/700 MS |
| 5,408,241 | 4/1995 | Shattuck, Jr. et al. | 343/846 X |

FOREIGN PATENT DOCUMENTS

| | | | |
|---|---|---|---|
| 1008825 | 3/1983 | U.S.S.R. | 343/700 MS |

*Primary Examiner*—Donald T. Hajec
*Assistant Examiner*—Steven Wigmore

[57] ABSTRACT

Dielectric components extend between top and bottom surfaces of a ground plane in a resonant microstrip patch antenna over a distance of one-quarter-wavelength of a resonant frequency of the antenna. The components form quarter-wave chokes within which waves cancel with reflected waves and reduce currents in the bottom surfaces of the ground plane. This reduces back lobe responses.

22 Claims, 2 Drawing Sheets

ANTENNAS WITH MEANS FOR BLOCKING CURRENT IN GROUND PLANES

RELATED APPLICATIONS

This application is related to our co-pending applications entitled "HIGH EFFICIENCY MICROSTRIP ANTENNAS" (Evans 18-24-8) and "IMPROVEMENTS IN SMALL ANTENNAS SUCH AS MICROSTRIP ANTENNAS" (Evans 19-25-9), both filed concurrently herewith.

FIELD OF THE INVENTION

This invention relates to microstrip patch antennas and particularly to means for reducing the currents on the back side of the ground plane.

BACKGROUND OF THE INVENTION

Practical ground planes for filters and microstrip patch antennas are inherently finite and limited in area. This results in currents in the bottom surfaces of the ground planes and these may generate undesirable back-lobe responses.

An object of the invention is to reduce these currents and the accompanying back-lobe response.

SUMMARY OF THE INVENTION

According to an aspect of the invention a dielectric component is incorporated in the interior of the ground plane of a microstrip antenna. Ideally the length of the dielectric component forms a quarter wave choke.

These and other aspects of the invention are pointed out in the claims. Other objects and advantages of the invention will become evident from the following detailed description when read in light of the accompanying drawings.

DETAILED DESCRIPTION OF PREFERRED EMBODIMENTS

Figure 1:
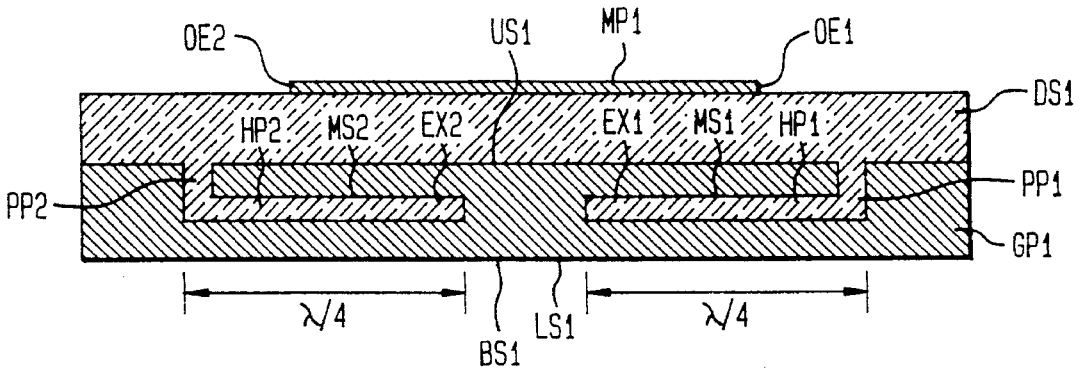
FIG. 1 is a section of an antenna embodying aspects of the invention.
Figure 2:
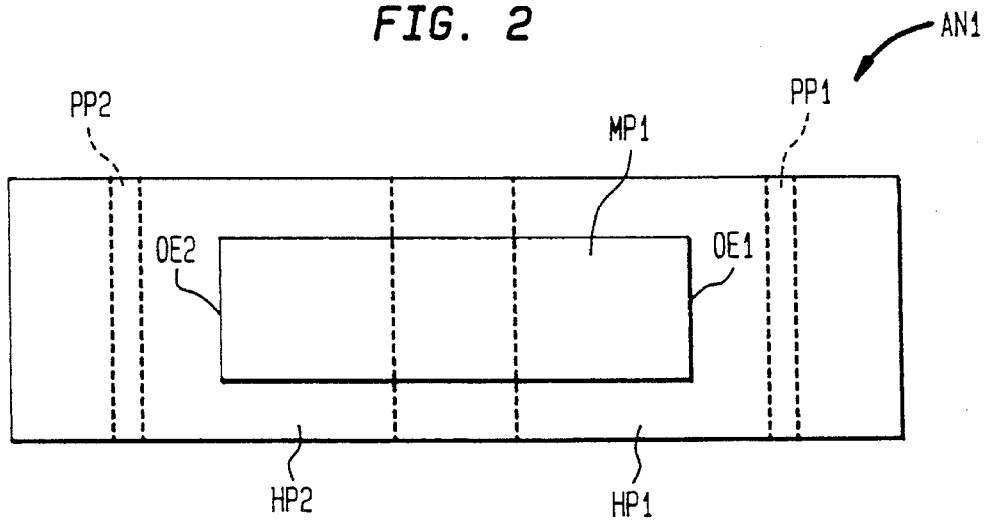
FIG. 2 is a plane view of FIG. 1.

FIGS. 1 and 2 illustrate a patch antenna AN1 embodying aspects of the invention. Here, a conductive ground plane GP1 supports a dielectric substrate DS1 having a dielectric constant $\epsilon_{r1}$. A resonating microstrip patch MP1 sandwiches the dielectric substrate DS1 between the patch and the ground plane GP1. The patch and the ground plane GP1 with the dielectric substrate DS1 resonate at a wavelength $\lambda_o$ in free space and a wavelength $\lambda$ in the dielectric substrate $\lambda=\lambda_o/\sqrt{\epsilon_{r1}}$. The dielectric substrate DS1 is coextensive with the ground plane GP1. The patch MP1 has a length $\lambda/2=\lambda_o/2\sqrt{\epsilon_{r1}}$. The ground plane GP1, the dielectric substrate DS1, and the patch MP1 have respective upper and lower surfaces parallel to each other and are suitably bonded to each other.

The invention integrates a quarter wave choke into the ground plane GP1. For this purpose an extension EX1 of the material of the dielectric substrate DS1 forms a perpendicular projection PP1 in a perpendicular opening in the ground plane GP1 and continues to form a horizontal projection HP1 in an opening between the upper and lower surfaces US1 and LS1 of the ground plane. The perpendicular projection PP1 starts beyond the outer edge OE1 of the patch MP1. The horizontal projection HP1 extends toward and ends before a plane through the median of the patch MP1.

A second mirror image extension EX2 of the dielectric substrate DS1 forms a perpendicular projection PP2 in a perpendicular opening in the ground plane GP1 and continues to form a horizontal projection HP2 in an opening between the surfaces US1 and LS1. The perpendicular projection PP2 starts beyond the outer edge OE2 of the patch MP1. The horizontal projection HP2 extends toward and ends before a plane through the median of the patch MP1.

The horizontal projections HP1 and HP2 each have a length $\lambda/4$ or $\lambda_o/4\sqrt{\epsilon_{r1}}$. These projections HP1 and HP2 form the quarter wave choke in the ground plane GP1.

The length of the patch MP1 is $\lambda/2$. Hence the currents in the patch at high frequencies are maximum in the center and minimal at the ends. At the same time currents in the upper surface US1 of the ground plane have currents which are maximum in the center and minimal at the dielectric breaks introduced by the perpendicular projections PP1 and PP2. Currents n the mid-surfaces MS1 and MS2, and MS3 and MS4, above and below the horizontal projections HP1 and HP2 are also maximum near the center and minimal at the breaks introduced by the projections PP1 and PP2. Outside the breaks and at the bottom surfaces BS1 the current is minimal in the frequency range of $f=c/\lambda$; such as 3 GHz. It is the currents in the patch MP1 and the upper surface US1 which resonate and produce or sense the radiating fields.

Figure 3:
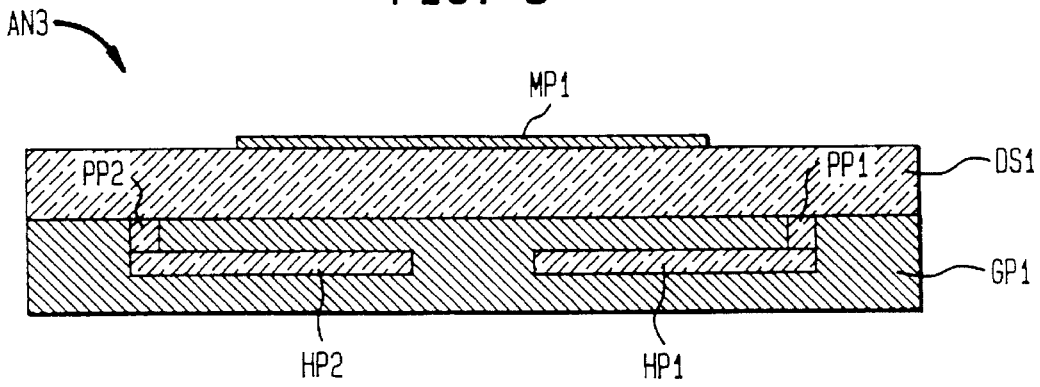
FIG. 3 is a section of another antenna embodying features of the invention.

The invention need not be embodied as shown in FIGS. 1 and 2. FIG. 3 shows another embodiment of the invention. Here, in an antenna AN3 the projections PP1, PP2, HP1, and HP2 are separate instead of being integral with the substrate DS1. Each projection has a dielectric constant $\epsilon_{r1}$.

In operation, a receiver or transmitter (not shown) connects to the patch MP1 and the ground plane GP1. In the receive mode as the antenna AN1 responds to radiation propagating transverse to the patch MP1. In the transmit mode, the antenna AN1 radiates transverse to the patch MP1. The latter, with the ground plane GP1 and the dielectric substrate DS1 resonate at a wavelength $\lambda=\lambda_o/\sqrt{\epsilon_r}$1in both receive and transmit mode. In both modes, currents flow in ground plane GP1 parallel to the patch MP1 and parallel to the plane of the page. These currents are responsible for undesirable back lobes. The currents generate waves in the quarter-wavelength chokes composed of the horizontal projections HP1 and HP2 in their openings in the ground plane GP1. These waves are reflected at the horizontal ends of the chokes. Because the chokes are each a quarter-wavelength the waves at one point of the projection choke are 180 degrees out of phase with the reflections within the chokes. This causes cancellation. The chokes absorb energy from the currents flowing in the outer parts of the ground plane and limit the ground plane currents, in the bottom of the ground plane that cause the undesirable back lobes.

Figure 4:
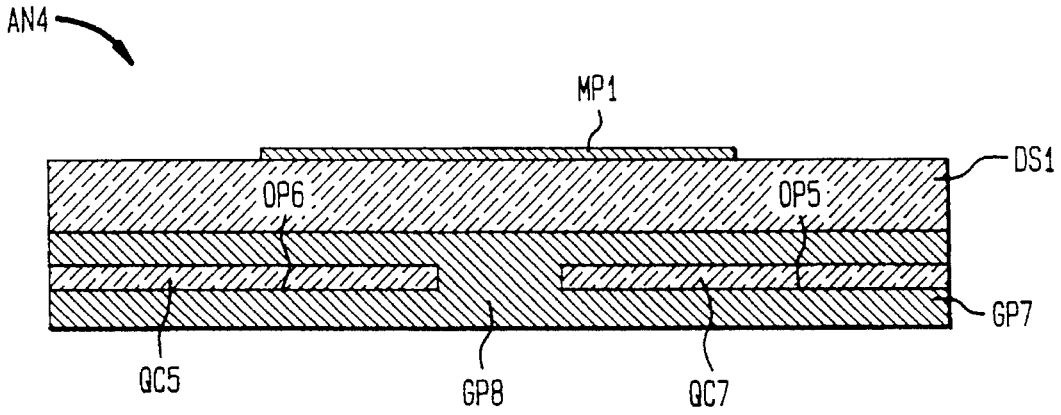
FIG. 4 is a section of another antenna embodying features of the invention.

FIG. 4 illustrates another embodiment of the invention. Here, quarter-wave chokes QC5 and QC6, formed by dielectric materials and openings OP6 and OP7 starting at the ends of a conductive ground plane GP7, each produce internal waves that cancel. This suppresses currents in the bottom side ground plane GP7.

In all the embodiments the chokes operate in a manner similar to FIGS. 1 and 2. The ground-plane currents produce waves in the chokes. The quarter-wavelength chokes cause cancellation of waves in the chokes and reduce ground plane currents. This reduces undesirable back lobe responses.

The dielectrics of the chokes in these embodiments need not have the same dielectric constant $\epsilon_{r1}$ as the substrate DS1. According to other embodiments the dielectrics of the chokes in FIGS. 1 to 4, including HP1 and HP2 have dielectric constants other than $\epsilon_{r1}$, namely $\epsilon_{r2}$. In that case each choke has the length $\lambda/4=\lambda_o/(4\sqrt{\epsilon_{r2}})$. That is each choke has a length suitable for a quarter wave with its dielectric constant.

In another embodiment, the structures having two chokes have separate dielectric constants in each choke. That is one choke has a dielectric constant $\epsilon_{r2}$ and the other $\epsilon_{r3}$. The length of one choke is $\lambda/4=\lambda_o/(4\sqrt{\epsilon_{r2}})$ and the second is $\lambda/4=\lambda_o/(4\sqrt{\epsilon_{r3}})$.

In all cases the lengths of the chokes are suitable for their own dielectric constants to produce a quarter-wavelength choke.

Figure 5:
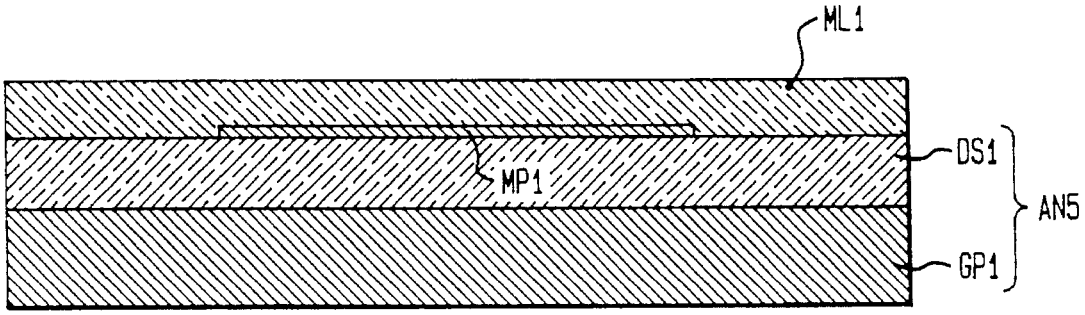
FIG. 5 is a section of another antenna embodying features of the invention.

Another embodiment of the invention incorporates one or more of the quarter wavelength (in thickness) matching layers of our aforementioned copending application entitled "Improvements In Small Antennas Such As Microstrip Patch Antennas" filed concurrently herewith. This is shown in FIG. 5 where the antenna AN5 represents any of the antennas in FIGS. 1 to 4. A matching layer ML1 above the substrate DS1 is a dielectric having a dielectric constant $\epsilon_{r8}$ between the dielectric constant $\epsilon_{r1}$ of the dielectric substrate DS1 and the dielectric constant 1 of free space, preferably $\sqrt{\epsilon_{r1}}$. The matching layer matches the dielectric substrate to the dielectric constant of free space. Preferably the layer has a thickness $\lambda/4$ or $\lambda_o/4\sqrt{\epsilon_{41}}$. The matching layer ML1 may be composed of a multiplicity of matching layers with each layer having a thickness $\lambda/4$ or $\lambda_o/4\sqrt{\epsilon_{r1}}$ and preferably dielectric constants such as $\sqrt[n+1]{\epsilon^{p}_{r1}}$, where n is the number of matching layers, p is the sequential number of any matching layer ending with the layer next to the substrate, and $\epsilon_{r1}$ is the dielectric constant of the substrate layer.

Another embodiment of the invention incorporates the thin microstrip patch disclosed in our aforementioned concurrently-filed copending application entitled "High Efficiency Microstrip Antennas". There, the effectiveness of a microstrip conductor antenna, such as a patch antenna, is improved at any particular frequency by making the thickness of the conductor sufficiently small to reduce shielding and losses caused by the skin effect and make currents at the upper and lower surfaces couple with each other and make the conductor partially transparent to radiation. In one embodiment the thickness is between $0.5\delta$ $\delta$ and $4\delta$. Preferably the thickness is between $1\delta$ and $2\delta$ where $\delta$ is equal to the distance at which current is reduced by 1/e., for example 1.5 to 3 micrometers at 2.5 gigahertz in copper. According to an embodiment, alternate layers of dielectrics and radiation transparent patches on a substrate enhance antenna operation.

The contents of the aforementioned concurrently-filed copending applications entitled "Improvements In Small Antennas Such As Microstrip Patch Antennas" and "High Efficiency Microstrip Antennas" are hereby incorporated into this application as if fully recited herein.

While embodiments of the invention have been described in detail, it will be evident to those skilled in the art that the invention may be embodied otherwise without departing from its spirit and scope.

What is claimed is:

1. An antenna, comprising a ground plane having a pair of parallel surfaces a dielectric substrate on one of said surfaces, a microstrip patch on said substrate;

a dielectric component in said ground plane and extending between said surfaces;

said dielectric component forming a quarter wave choke in said ground plane.

2. An antenna, comprising a ground plane having a pair of parallel surfaces a dielectric substrate on one of said surfaces, a microstrip patch on said substrate;

a dielectric component in said ground plane and extending between said surfaces;

a second dielectric component between the surfaces;

said components forming quarter wave chokes in said ground plane.

3. An antenna, comprising a ground plane having a pair of parallel surfaces a dielectric substrate on one of said surfaces, a microstrip patch on said substrate and forming a microstrip patch antenna section with said dielectric substrate and ground plane;

a dielectric component projecting into said said ground plane and extending between said surfaces and parallel to said surfaces so as to form a choke in said microstrip antenna section.

4. An antenna as in claim 3, wherein said patch is dimensioned to resonate at a given wavelength depending on a dielectric constant of said substrate, and said dielectric component extends between said surfaces a distance substantially equal to a quarter of said wavelength.

5. An antenna as in claim 3, wherein said patch extends along a given direction and said dielectric component extends parallel to the direction of said patch.

6. An antenna as in claim 3, wherein the patch has a length L in a direction and said dielectric component has a length substantially equal L/2 in the same direction.

7. An antenna as in claim 3, wherein, said dielectric component forms a quarter wave choke in said ground plane.

8. An antenna as in claim 3, wherein said dielectric substrate has a dielectric constant $\epsilon_{r1}$, the patch has a dimension $L=\lambda_o/(2\sqrt{\epsilon_{r1}})$, where $\lambda_o$ is a wavelength at which the patch resonates in free space, and said dielectric component has a length $\lambda_o/(4\sqrt{\epsilon_{r1}})$.

9. An antenna as in claim 3, wherein said patch has a dimension $L=\lambda/2$, where $\lambda$ is a wavelength at which the patch resonates in the dielectric component and the dielectric has a length L/2.

10. An antenna as in claim 3, wherein said substrate and said dielectric component have the same dielectric constant.

11. An antenna as in claim 3, wherein said ground plane has an opening coextensive with said dielectric component.

12. An antenna as in claim 3, wherein said substrate and said dielectric component have different dielectric constants.

13. An antenna as in claim 3, wherein said component is a first component, and further comprising a second dielectric component projecting in to said ground plane between the surfaces and parallel to the surfaces and forming a choke in said ground plane.

14. An antenna as in claim 13, wherein said patch is dimensioned to resonate at a given wavelength depending on a dielectric constant of said substrate, and each of said components extends between said surfaces a distance substantially equal to a quarter of said wavelength.

15. An antenna as in claim 13, wherein said patch extends along a given direction and said dielectric components extend parallel to the direction of said patch.

16. An antenna as in claim 13, wherein the patch has a length L in one direction and said dielectric components have lengths substantially equal L/2 in the same direction.

17. An antenna as in claim 13, wherein said components form quarter wave chokes in said ground plane.

18. An antenna as in claim 13, wherein said dielectric substrate has a dielectric constant $\epsilon_{r1}$, the patch has a dimension $L=\lambda_o/(2\sqrt{\epsilon_{r1}})$, where $\lambda_o$ is a wavelength at which the patch resonates in free space, and said dielectric components have a length $\lambda_o/(4\sqrt{\epsilon_{r1}})$.

19. An antenna as in claim 13, wherein said substrate and said dielectric components have the same dielectric constant.

20. An antenna as in claim 13, wherein said ground plane has openings coextensive with said dielectric components.

21. An antenna as in claim 13, wherein said substrate has a dielectric constant $\epsilon_{r1}$ and said dielectric components have dielectric constants $\epsilon_{r2}$, and the lengths of said components is $\lambda_o/(4\sqrt{\epsilon_{r2}})$ where $\lambda_o$ is a wavelength at which the patch resonates in free space.

22. An antenna as in claim 13, wherein said ground plane has edges and said dielectric components project inwardly from edges of said ground plane.

* * * * *